US008288929B2

(12) United States Patent
Nunome et al.

(10) Patent No.: US 8,288,929 B2
(45) Date of Patent: Oct. 16, 2012

(54) SPARK PLUG

(75) Inventors: Kenji Nunome, Nagoya (JP); Yoshikuni Sato, Nagoya (JP)

(73) Assignee: NGK Spark Plug Co., Ltd., Aichi (JP)

( * ) Notice: Subject to any disclaimer, the term of this patent is extended or adjusted under 35 U.S.C. 154(b) by 123 days.

(21) Appl. No.: 12/521,206

(22) PCT Filed: Apr. 17, 2008

(86) PCT No.: PCT/JP2008/057537

§ 371 (c)(1),
(2), (4) Date: Jun. 5, 2009

(87) PCT Pub. No.: WO2009/037884

PCT Pub. Date: Mar. 26, 2009

(65) Prior Publication Data

US 2009/0289540 A1 Nov. 26, 2009

(30) Foreign Application Priority Data

Sep. 18, 2007 (JP) ..... 2007-241316

(51) Int. Cl.
*H01T 13/20* (2006.01)

(52) U.S. Cl. ..... 313/141; 313/143; 313/145

(58) Field of Classification Search ..... 313/118–145, 313/169 R, 169 EL, 32, 41, 310
See application file for complete search history.

(56) References Cited

U.S. PATENT DOCUMENTS 4,970,426 A 11/1990 Bronchart
5,530,313 A * 6/1996 Chiu ..... 313/141
5,866,973 A * 2/1999 Kagawa et al. ..... 313/141
6,304,022 B1 10/2001 Matsutani
6,621,198 B2 * 9/2003 Kanao et al. ..... 313/141
2001/0025617 A1 10/2001 Kanao
2003/0155849 A1 8/2003 Hori
2005/0067933 A1 * 3/2005 Kato ..... 313/141

(Continued)

FOREIGN PATENT DOCUMENTS

JP 01-100887 A 4/1989

(Continued)

OTHER PUBLICATIONS

Desk Edition: Tool and manufacturing engineers handbook by W. H. Cubberly, Ramon Bakerjian chapter 39, p. 39-1, 6th paragraph (Improvements in quality), lines 1-3. 1989.*

(Continued)

*Primary Examiner* — Mariceli Santiago
*Assistant Examiner* — Donald Raleigh
(74) *Attorney, Agent, or Firm* — Sughrue Mion, PLLC

(57) ABSTRACT

A spark plug comprising a center electrode, a first noble metal tip joined to the center electrode, an insulator, a metallic shell, a ground electrode joined to the metallic shell and including an outer layer and an inner layer, and a second noble metal tip joined to the ground electrode by way of a melted portion, wherein in a cross section of the ground electrode, the protrusion height A of the second noble metal tip is 0.4mm or more, the ground electrode includes a substantially flat joining surface to which the second noble metal tip is joined and an outwardly curved surface, the inner layer has at the joining surface side a substantially flat surface or recessed surface, and the minimum distance F between the melted portion and the inner layer is 0.1mm or more.

7 Claims, 15 Drawing Sheets

U.S. PATENT DOCUMENTS

| | | | | |
|---|---|---|---|---|
| 2007/0080618 | A1* | 4/2007 | Torii et al. | 313/143 |
| 2007/0103046 | A1* | 5/2007 | Tinwell | 313/143 |
| 2007/0216275 | A1* | 9/2007 | Torii et al. | 313/141 |
| 2007/0216277 | A1* | 9/2007 | Yoshida et al. | 313/141 |
| 2008/0122334 | A1* | 5/2008 | Kishimoto et al. | 313/141 |

FOREIGN PATENT DOCUMENTS

| | | | |
|---|---|---|---|
| JP | 05-013146 | A | 1/1993 |
| JP | 05-101869 | A | 4/1993 |
| JP | 11-121142 | A | 4/1999 |
| JP | 11-204233 | A | 7/1999 |
| JP | 2001-351761 | A | 12/2001 |
| JP | 2003-317896 | A | 11/2003 |
| JP | 2007265843 | A * | 10/2007 |

OTHER PUBLICATIONS

Chinese Office Action corresponding to CN 200880004167.8, issued Apr. 2, 2011.

* cited by examiner

SPARK PLUG

CROSS REFERENCE TO RELATED APPLICATION

This application is a National Stage of International Application No. PCT/JP2008/057537 filed Apr. 17, 2008, claiming priority based on Japanese Patent Application No. 2007-241316, filed Sep. 18, 2007, the contents of all of which are incorporated herein by reference in their entirety.

TECHNICAL FIELD

The present invention relates to a spark plug for use with an internal combustion engine.

BACKGROUND TECHNIQUE

A spark plug for an internal combustion engine such as an automotive engine is provided with, for example, a center electrode, an insulator provided at the outside of the center electrode, a tubular metallic shell provided at the outside of the insulator and a ground electrode with a base end portion joined to a front end surface of the above-described metallic shell. The ground electrode has a substantially rectangular cross section and is disposed so that its front end portion inner surface faces a front end portion of the above-described center electrode, whereby a spark discharge gap is formed between the front end portion of the center electrode and the front end portion of the ground electrode.

The metallic shell is formed at an outer circumferential surface with an unshown thread portion. The spark plug is threadedly attached to a spark plug hole having a female thread and formed in a cylinder head of an engine. In the meantime, in case in an installed state of the spark plug, the mixture gas has such a positional relationship of lashing against a back face of the ground electrode, there is a fear of the ground electrode obstructing flow of a mixture gas into a spark discharge gap. As a result, there is a fear of variations in the ignitability being caused.

In contrast to this, there is a technique that in a spark plug of the type having two or more ground electrodes, each ground electrode is formed into a cylindrical shape having a substantially circular cross section (refer to, for example, Patent Document 1). By making, in this manner, the cross section be substantially circular-shaped, the mixture gas is hard to come off from the ground electrode but is caused to turn around the ground electrode into the inside thereof even when the mixture gas has such a positional relationship of lashing against the back face of the ground electrode, thus enabling the mixture gas to reach the spark discharge gap easily.

Further, there is a technique that the cross section of the ground electrode is formed into a substantially trapezoidal shape (refer to, for example, Patent Document 2). By making, in this manner, the cross section be substantially trapezoidal-shaped, it can be said that the mixture gas reaches the spark discharge gap more easily as compared with the case the cross section is rectangular.

Patent Document 1: Unexamined Japanese Patent Application Publication No. 11-121142

Patent Document 2: Unexamined Japanese Patent Application Publication No. 5-13146

DISCLOSURE OF THE INVENTION

Problem to be Solved by the Invention

However, for the reason that the ground electrode is to be joined to the front end surface of the metallic shell, if the cross section of the ground electrode is circular-shaped, its sectional area inevitably becomes smaller as compared with the case where the cross section is rectangular-shaped. As a result, there is a fear of a so-called heat-drawing (heat radiation ability) becoming worse, and the electrode temperature rising easily at high-speed driving and the like such that the rate of exhaustion of the ground electrode becomes larger and its durability is lowered.

Further, while in recent years, it has also been considered to join tips made of noble metal alloy (noble metal tips) to a front end portion of a center electrode and a front end portion of a ground electrode, respectively and thereby improve the ignitability and the spark propagation ability, there is an anxiety that in case the cross section of the ground electrode is circular-shaped as the above-described Patent Document 1, it is worried that soldering of the noble metal tip on the ground electrode side might become difficult.

Further, while in Patent Document 2, it is described that the ground electrode includes an outer layer and an inner layer that is superior in thermal conductivity to the outer layer and there is a suggestion about improvement in the heat-drawing ability, there is not any description about a noble metal tip joining method. In this connection, if, for example, the noble metal tip is welded by resistance welding, a sufficient joining strength cannot be obtained. Further, in case, for example, the noble metal tip is welded by laser or electron beam welding or the like, there is a fear that a welded portion might be extended over the inner layer, and in such a case, there is a fear that the oxidation-resistant property is lowered due to formation of oxidation scales.

The present invention has been made in view of the above-described circumstances and has for its object to provide a spark plug for an internal combustion engine, which can inhibit obstruction to flow of a mixture gas into a spark discharge gap, prevent lowering of the ignitability and improve the joining strength of a noble metal tip thereby improving the durability.

Means for Solving the Problem

Hereinafter, each structure suited to solve the above-described problem and the like will be described by being itemized. In the meantime, according to the necessity, an operation effect peculiar to a corresponding structure will be described additionally.

A spark plug according to a first structure of the present invention includes a rod-shaped center electrode, a first noble metal tip joined to a front end of the center electrode, a substantially cylindrical insulator provided at an outer circumference of the center electrode, a tubular metallic shell provided at an outer circumference of the insulator, a ground electrode having a base end portion joined to a front end surface of the metallic shell, and a front end portion facing a front end portion of the center electrode, the ground electrode including an outer layer made of nickel alloy and an inner layer made of a material having a better thermal conductivity than the outer layer, and a second noble metal tip joined to the front end portion of the ground electrode by way of a melted portion formed by laser welding or beam welding and forming a spark discharge gap between the second noble metal tip and the first noble metal tip, wherein in a cross section of the ground electrode as viewed from the front end surface side of the ground electrode along the axis of the second noble metal tip, the following features (1) to (4) are provided. Namely, (1) the protrusion height A of the second noble metal tip from the joining surface to the front end of the second noble metal tip is 4 mm or more, (2) the ground electrode has a substantially flat joining surface to which the second noble metal tip is joined and an outwardly curved surface, (3) the inner layer has at the joining surface side a substantially flat surface or recessed surface, and (4) the minimum distance F between the melted portion and the inner layer is 0.1 mm or more.

By the above-described first structure, the ground electrode has an outwardly curved surface. For this sake, the mixture gas turn around along the curved surface and into the inside of the ground electrode and reaches the spark discharge gap with ease. As a result, it becomes possible to prevent the ignitability from being lowered.

Further, the ground electrode has at least a spark discharging portion an outer layer made of nickel alloy and an inner layer made of metal of a better heat conductivity than the outer layer. The existence of the outer layer can elevate the durability against oxidation, while at the same time the existence of the inner layer can improve the heat drawing, whereby a drawback due to a rise of a ground electrode temperature at high-speed driving and the like, such as increase of a spark discharge gap due to consumption of the ground electrode, can be inhibited with ease.

Further, to the center electrode and the ground electrode are welded respective noble metal tips to improve the spark consumption resistance under high temperature. Particularly, with the first structure, the protrusion height A from the joining surface of the ground electrode to the front end of the second noble metal tip is set to 0.4 mm or more such that the more improvement in the ignitability can be attained.

Further, with the first structure, at least the joining surface of the ground electrode, to which the second noble metal tip is joined, is substantially flat-shaped. For this reason, as compared with the case the joining surface is formed into a curved surface, complication of the joining work can be avoided with ease and improvement in the joining strength can be attained.

Furthermore, the second noble metal tip is welded to the joining surface by way of a melted portion formed by the metal constituting the second noble metal tip and the metal constituting the outer layer of the ground electrode, which are melted and mixed with each other by being subjected to at least laser beam welding or electron beam welding. For this reason, the joining strength of the second noble metal tip can be improved and the joining state can be stabilized further.

Furthermore, with this first structure, the joining surface side (second noble metal tip side) of the second noble metal tip is substantially flat-shaped or recess-shaped. For this sake, even if the depth of the melted portion is set relatively large, the shortest distance F between the melted portion and the inner layer can be attained by 0.1 mm or more with ease. Accordingly, improving the joining strength of the second noble metal tip while inhibiting decrease in the resistance to oxidation, which are, so to speak, conflicting effects, can be attained at a stroke.

In the meantime, as a method of joining the second noble metal tip to the ground electrode can be cited welding such as laser welding or electron beam welding that can form a melted portion as described above. However, it is more desirable to perform temporary attachment by resistance welding, prior to the above-described laser welding or electron beam welding, than performing such welding without any pretreatment.

Further, even if the melted portion formed by laser welding or electron beam welding is relatively small so that there exists between the second noble metal tip and the outer layer an area in which there is not any melted portion, joining between the second noble metal tip and the outer layer can be obtained securely since resistance welding is performed beforehand, thus wiping away a fear of falling off of the second noble metal tip and the like.

Further, while it has been described as above that the outer layer of the ground electrode is made of nickel alloy, it is desirable that at least a portion of the inner layer that is made of a material having a better thermal conductivity than the outer layer is made of a material including copper as a major constituent. By having the inner layer whose major constituent is copper, good heat drawing can be attained, and a drawback that is caused by temperature rise of the ground electrode and the second noble metal tip can be inhibited more assuredly. In the meantime, the ground electrode is not limited to a two-layer structure but may be of a structure of three layers or more. However, the inner layer needs to contain a metal having a better thermal conductivity than the outer layer. Accordingly, in case, for example, there are inside the outer layer an intermediate layer made of a copper alloy or pure copper and inside the intermediate layer an innermost layer made of pure nickel, the inner layer can be construed as being constituted by the intermediate layer and the innermost layer.

Further, for obtaining a sufficient joining strength, it is desirable that in the above-described cross section, the depth E of the melted portion from the joining surface toward the inner layer along the axial direction is 0.1 mm or more.

Further, in consideration of the aspect of production, it is desirable to employ the following structures 6 to 9.

Further, a spark plug according to a second structure of the present invention includes a rod-shaped center electrode, a first noble metal tip joined to a front end of the center electrode, a substantially cylindrical insulator provided at an outer circumference of the center electrode, a tubular metallic shell provided at an outer circumference of the insulator, a ground electrode having a base end portion joined to a front end surface of the metallic shell, and a front end portion facing a front end portion of the center electrode, the ground electrode including an outer layer made of nickel alloy and an inner layer made of a material having a better thermal conductivity than the outer layer, a second noble metal tip joined to the front end portion of the ground electrode by way of a melted portion formed by laser welding or beam welding and forming a spark discharge gap between the second noble metal tip and the first noble metal tip, wherein in a cross section of the ground electrode as viewed from the front end surface side of the ground electrode along the axis of the second noble metal tip, the following features (1) to (4) are provided. Namely, (1) the protrusion height A of the second noble metal tip from the joining surface to the front end of the second noble metal tip is 0.4 mm or more, (2) the ground electrode includes a substantially flat joining surface to which the second noble metal tip is joined and an outwardly curved surface, (3) the inner layer has at the joining surface side a substantially flat surface or recessed surface, and (4) the melted portion is disposed at a distance from the joining surface.

In such a second structure, the features (1) to (3) are common with the first structure but the feature (4) differs.

Namely, in the second structure, since the second noble metal tip is welded to the joining surface of the ground electrode by way of the intermediate member, the melted portion is formed between the second noble metal tip and the intermediate member and is positioned at a distance from the joining surface. Accordingly, there is not any fear of the welded portion reaching the inner layer to lower the resistance to oxidation. In the meantime, it is desirable to make the intermediate member by the same nickel alloy as the ground electrode and join them by resistance welding.

Further, in the second structure, by using the intermediate member, the protrusion height A of the second noble metal tip from the joining surface to the front end of the second noble metal is set to 4 mm or more. Namely, since a portion of the protrusion height A can be constituted by an intermediate member, the amount of noble metal used can be reduced.

Further, for securing the heat radiation ability of the noble metal tip while maintaining the effect of reducing the amount of noble metal used, it is preferable to set, in the above-described cross section, the shortest distance T between the joining surface and the inner layer smaller than the protrusion height H of the intermediate member from the joining surface.

Further, for performing, in the spark plugs of the first and second structures, heat radiation of the inner layer effectively, it is preferable that the shortest distance T between the joining surface and the inner layer is 0.4 mm or less.

Further, for performing heat radiation by the inner layer effectively, it is preferable that the inner layer of a sufficient width is positioned just under the second noble metal tip. Specifically, assuming W denotes the width of the front end surface of the second noble metal tip in the above-described cross section and C denotes the width of the inner layer in the direction parallel to the joining surface in the above-described cross section, it is preferable to satisfy $W \leqq C$ In addition, in the spark plugs of the first and second structures, it is preferable to form the ground electrode including the joining surface by swaging.

In general, as a method of forming a metallic material so that the material becomes slender and round are cited, for example, a drawing process using a dice or the like, an extrusion process using a female die or the like, a cutting process, electro discharge machining, or the like. However, from a point of view of stably producing a ground electrode that has a plural-layer structure and is relatively thin and substantially circular in section, it is difficult to employ any of the above-described machining and processes independently. For example, by only the drawing process or the protrusion process, it is actually difficult to make smaller the diameter so that the diameter is equal to or less than 1.5 mm and the cost is increased. Further, by the cutting process and the electro machining process, a variation of each product is liable to be caused, and further a variation in the central position of the inner layer relative to the ground electrode is liable to be caused. Furthermore, the machining work is inefficient, thus increasing the cost.

In contrast to this, by performing swaging, the ground electrode can be obtained stably and without difficulty and the spark plug can be produced.

Further, by performing swaging, the machining rate of the portion where the joining surface (center electrode side) is provided becomes larger, and the hardness can be made larger.

BEST MODE FOR CARRYING OUT THE INVENTION (First Embodiment)

Figure 1:
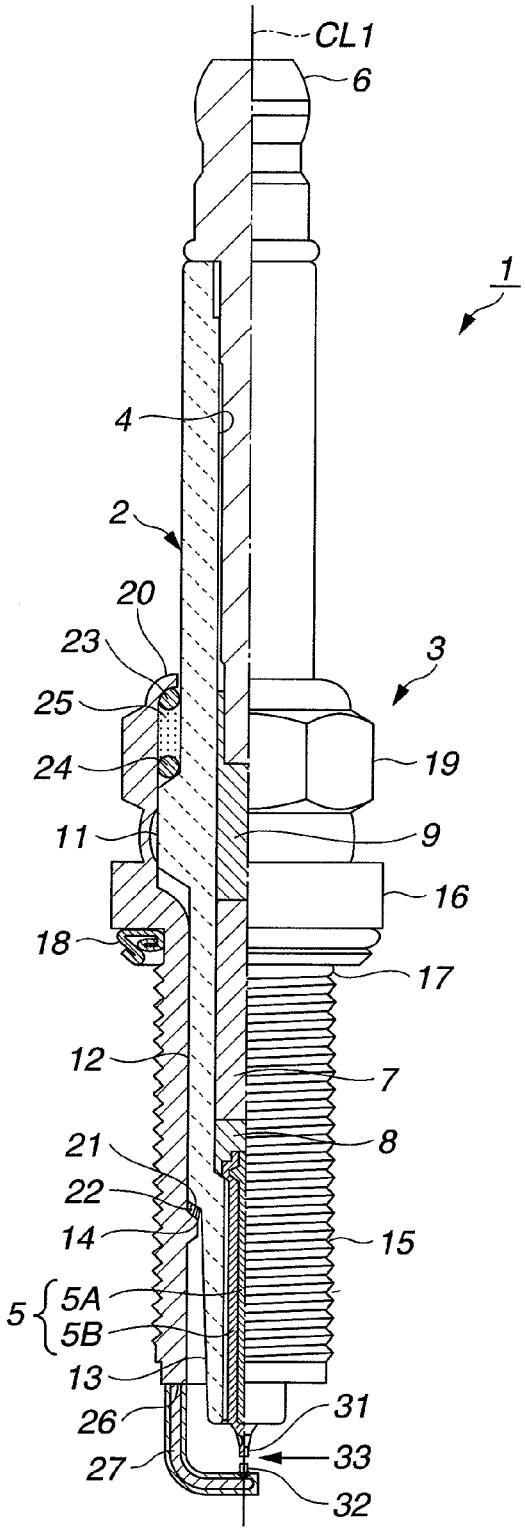
FIG. 1 is a partially cutaway elevational view showing a structure of a spark plug according to a first embodiment.

Hereinafter, the first embodiment will be described with reference to drawings. FIG. 1 is a partially cutaway elevational view showing a spark plug 1. In the meantime, description will be made by regarding, in FIG. 1, an axial CL1 direction of the spark plug 1 as a vertical direction in the drawing, the lower side as the front end side of the spark plug 1 and the upper side as the rear end side.

The spark plug 1 is constituted by an insulator 2 having a long shape, a tubular metallic shell 3 holding the insulator and so on.

The insulator 2 is formed with an axial hole 4 extending therethrough along an axis CL1. Into the front end side of the axial hole 4 is inserted and fixed thereat a center electrode 5. Further, into the rear end side of the axial hole 4 is inserted and fixed thereat a terminal electrode 6. Between the center electrode 5 and the terminal electrode 6 within the axial hole 4 is disposed a resistor 7, and the resistor 7 is electrically connected to the center electrode 5 and the terminal electrode 6 by way of respective conductive glass seal layers 8 and 9.

To a front end of the center electrode 5 protruding from the front end of the insulator 2 is welded a first noble metal tip 31 containing 5 wt. % of platinum.

On the other hand, the insulator 2 is formed by sintering alumina, etc. as is well known and has at an outer periphery a large diameter portion 11 positioned substantially in the middle part in the axial CL1 direction and in the form of a flange protruding radially outward, a middle portion 12 positioned more on the front end side than the large diameter portion 11 and formed so as to be smaller in diameter than the large diameter portion, and a leg portion 13 position more on the front end side than the middle portion 12, formed so as to be smaller in diameter than the middle portion and adapted to be exposed to a combustion chamber of an internal combustion engine (engine). The front end side of the insulator 2, including the large diameter portion 11, the middle portion 12 and the leg portion 13 is accommodated in the tubular metallic shell 3. At a connecting part between the leg portion 13 and the middle portion 12 is provided a shoulder portion 14, and the insulator 2 is lockingly engaged at the shoulder portion 14 with the metallic shell 3.

The metallic shell 3 is formed by low-carbon steel or the like metal into a tubular shape and formed at the outer circumferential surface with a thread portion (male thread portion) 15 for attaching the spark plug 1 to the cylinder head of the engine. The outer circumferential surface on the rear end side of the threaded portion 15 is formed with a seat portion 16, and a gasket 18 is fitted on a neck portion 17 at the rear end of the threaded portion 15. Further, on the rear end side of the metallic shell 3 is provided a tool engagement portion 19 having a hexagonal cross section and engaged by a wrench or the like tool at the time of attachment of the metallic shell 3 to the cylinder head, and at the same time at the rear end portion is provided a crimped portion 20 for holding the insulator 2.

Further, at the inner circumferential surface of the insulator 2 is provided a shoulder portion 21 for locking engagement with the insulator 2. The insulator 2 is inserted from the rear end side of the metallic shell 3 toward the front end side, and is fixed under a condition of its shoulder 14 being lockingly engaged with the shoulder portion 21 of the metallic shell 3 by crimping a rear end side opening portion of the metallic shell 3 radially inward, i.e., by forming the above-described crimped portion 20. In the meantime, between the shoulder portions 14 and 21 of both of the insulator 2 and the metallic shell 3 is interposed a circular ring-shaped plate packing 22. By this, the airtightness of the combustion chamber is maintained, and the fuel-air coming into the space between the leg portion 13 of the insulator 2 and the inner circumferential surface of the metallic shell 3, which are exposed to the inside of the combustion chamber, is prevented from leaking therefrom.

Further, for making the airtight by the crimping more assured, circular ring members 23 and 24 are provided on the rear end side of the metallic shell 3 and interposed between the metallic shell 3 and the insulator 2, and power of talc 25 is filled up between the ring members 23 and 24. Namely, the metallic shell 3 holds the insulator 2 by way of the plate packing 22, ring members 23, 24 and talc 25.

Further, to the front end surface of the metallic shell 26 is joined a substantially L-shaped ground electrode 27. Namely, the ground electrode 27 is welded at the base end portion to the front end surface 26 of the metallic shell 3 while being bent at the front end side, and is disposed so that one side surface on the front end side thereof faces the first noble metal tip 31. To the front end portion of the ground electrode 27 is provided a second noble metal tip 32 in such a manner as to face the first noble metal tip 31. A gap between the first and second noble metal tips 31 and 32 is adapted to serve as a spark discharge gap 33. In the meantime, the axes of the first and second noble metal tips 31 and 32 are disposed so as to coincide with the axis CL1 so that the axis CL1 serves as both of the axes of the first and second noble metal tips 31 and 32.

Figure 2:
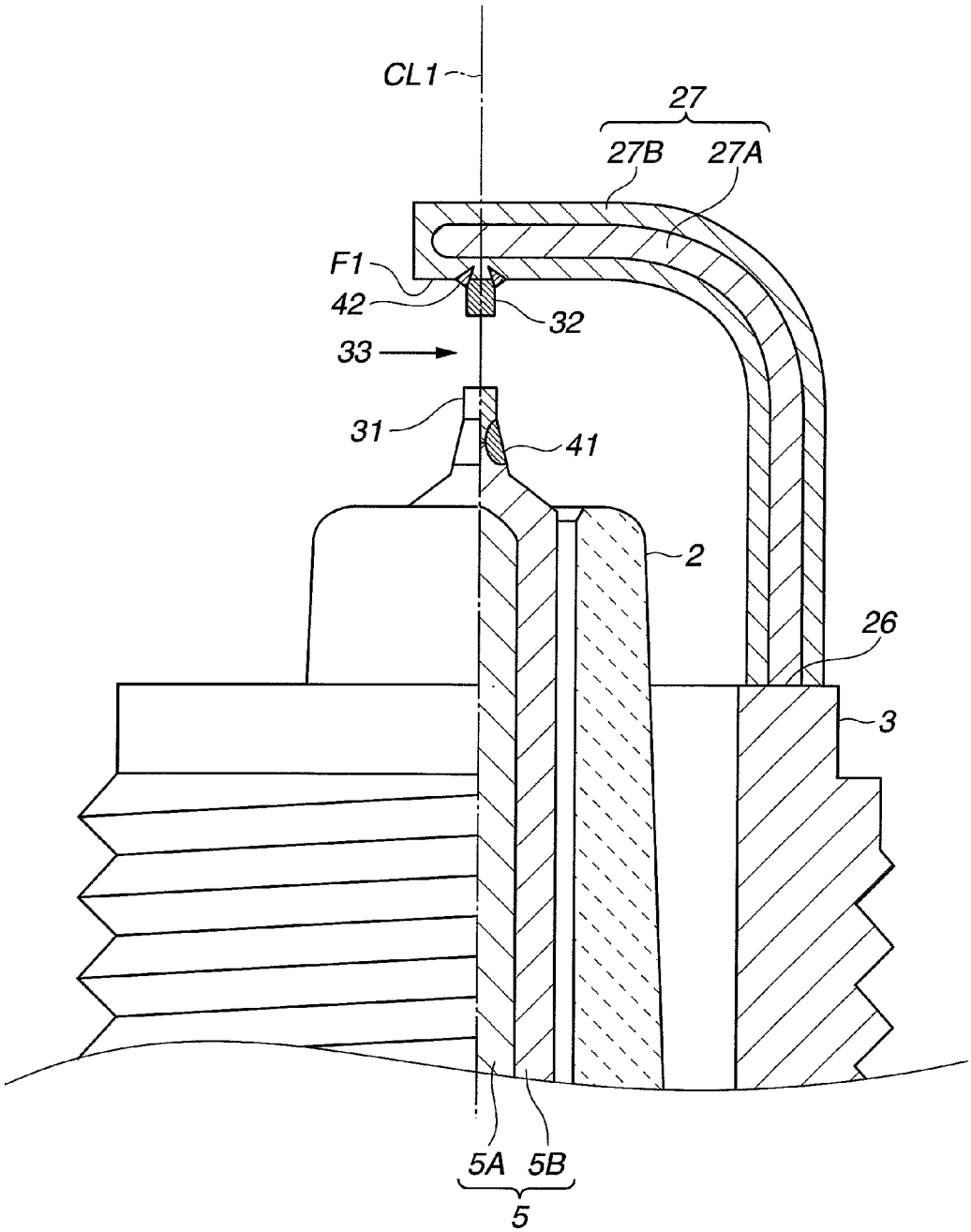
FIG. 2 is an enlarged fragmentary sectional view of the spark plug.

As shown in FIG. 2, the center electrode 5 is constituted by an inner layer 5A made of copper or copper alloy and an outer layer 5B made of nickel (Ni) alloy. The center electrode 5 is decreased in diameter on the front end side and generally rod-shaped (cylindrical-shaped), and its front end surface is formed so as to be flat. On the front end surface is laid the above-described first noble metal tip 31, and along an outer peripheral portion of that joining surface is performed laser welding or electro beam welding thereby allowing the first noble metal tip 31 and the center electrode 5 to melt together and form a melted portion 41. Namely, the first noble met al tip 31 is joined to the front end of the center electrode 5 by sticking thereto at the melted portion 41.

On the other hand, the ground electrode 27 is of a two-layer structure including an inner layer 27A and an outer layer 27B. The outer layer 27B of this embodiment is formed by nickel alloy such as Inconel 600 or Inconel 601 (either is registered trademark). In contrast to this, the inner layer 27A is formed by copper alloy or pure copper that is a metal having a better thermal conductivity than the above-described nickel alloy. By the existence of the inner layer 27A, improvement in the heat drawing ability is attained (detailed description in this connection will be made hereinlater). In the meantime, in this embodiment, the ground electrode is described as being of a simple two-layer structure for convenience of description but it may be of a three-layer structure or of a multilayer structure with layers equal to or more than four layers. However, as against the outer layer 27B, the layer inside the outer layer needs to contain a metal having a better thermal conductivity than the outer layer 27B. Accordingly, for example, an intermediate layer made of a copper alloy or pure copper may be provided inside the outer layer 27B, and an innermost layer made of pure nickel may be provided inside the intermediate layer. In this case, the inner layer 27A is constituted by the intermediate layer and the innermost layer.

Further, in this embodiment, the ground electrode 27 is shaped to have such a circular cross section that is partly crushed. Of the ground electrode 27, a front end including at least a portion to which the second noble metal tip 32 is joined (in this embodiment, all the area in the longitudinal direction), is swaged so as to have a substantially flat surface shape. Although the method of this processing will be described in detail later, by the above-described swaging, the center electrode 5 side surface of the outer layer 27B is formed with a flat surface F1. In other words, the outer peripheral shape of the cross section of the ground electrode 27 as viewed from the front end surface of the ground electrode 27 along the axis CL1 is of such a shape that is obtained by cutting off a segment from a substantially circular shape so that a more than half part of the circular shape remains. In this embodiment, by going through the swaging, the center electrode 5 side portion of the outer electrode 27B has a larger hardness than the back surface side portion that is on the side opposite to the center electrode 5.

Further, while it has already been described that the first noble metal tip 31 on the center electrode 5 side contains iridium as a major constituent, the second noble metal tip 32 on the ground electrode 27 side is made of a noble metal alloy containing, for example, platinum as a major constituent and 20% rhodium. However, such a material structure is only for the purpose of illustration, the above description is not for the purpose of limitation. These first and second noble metal tips 31 and 32 are produced, for example, as follows. First, an ingot containing iridium or platinum as a major constituent is prepared, each alloy constituent is mixed and melted so that the above-described predetermined composition is obtained, from this melted alloy an ingot is formed again, and thereafter the ingot is processed by hot-forging and hot rolling (groove rolling). Then, after a rod-shaped material is obtained by a drawing process, it is cut to a predetermined length thereby obtaining the first and second noble metal tips 31 and 32 in the form of a cylinder.

Figure 5:
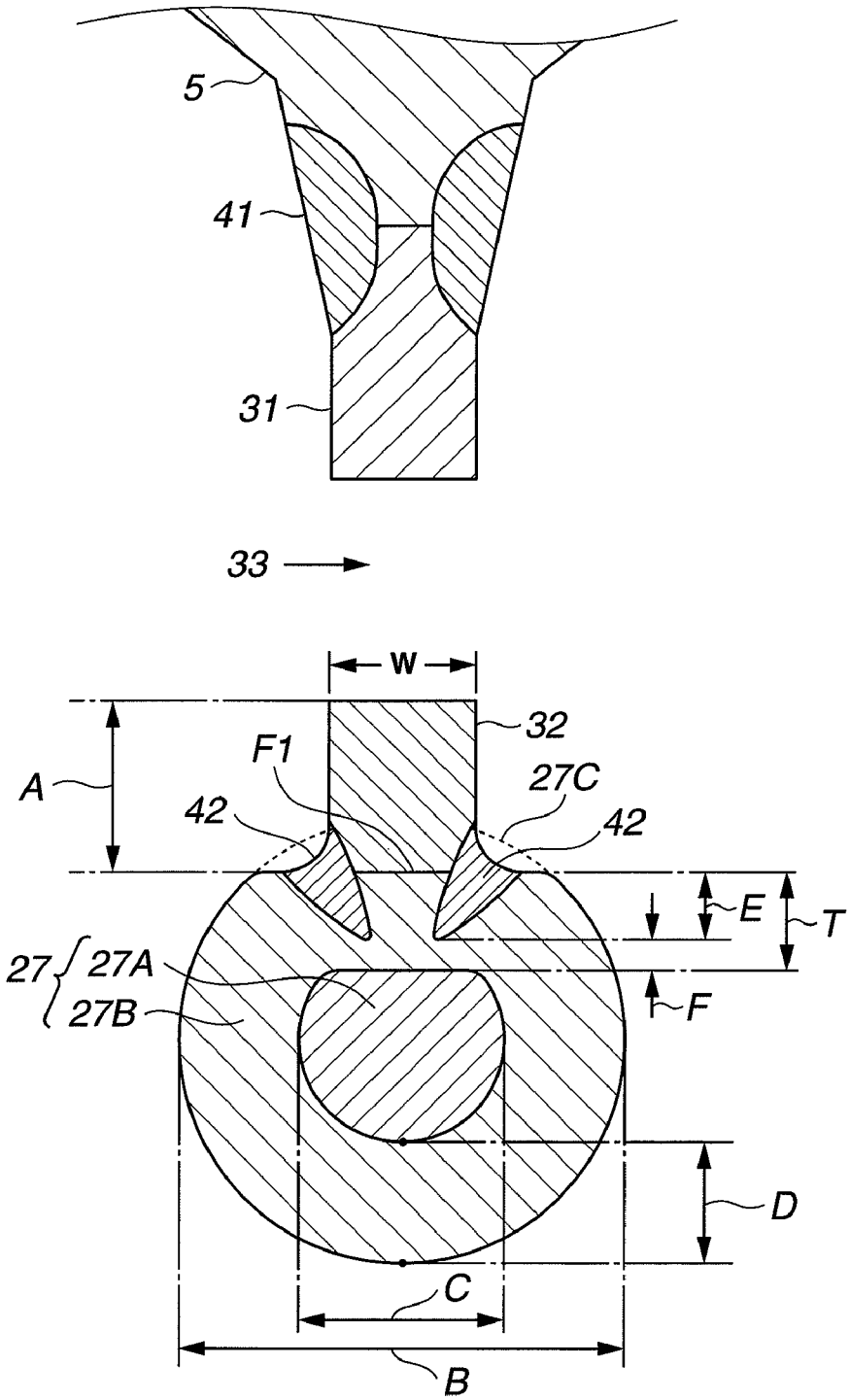
FIG. 5 is a schematic sectional view of a ground electrode, etc. as viewed from a front end side of the ground electrode along an axis.

By the way, as shown in FIG. 5, the second noble metal tip 32 on the ground electrode 27 side in this embodiment is directly joined to the front end portion (flat surface F1) of the ground electrode 27. More specifically, the second noble metal tip 32 is first temporarily attached to the flat surface F1 by resistant welding. In addition to that, along the outer peripheral portions of the abutting surfaces is performed laser welding or electron beam welding. By this, the second noble metal tip 32 and the outer layer 27B are melted together to form the melted portion 42 thereby making the second noble metal tip 32 and the ground electrode 27 be firmly joined and fixed. However, the melted portion 42 is not extended to the inner layer 27A, i.e., the melted portion 42 is in a non-contact state with the inner layer 27A.

Further, in this embodiment, the protrusion height A from the joining surface of the second noble metal tip 32, i.e., the flat surface F1, to the front end of the second noble metal tip 32 is set to 0.4 mm or more. Further, in a cross section of the ground electrode 27 as viewed from the front end side of the ground electrode 27 along the axis CL1 of the noble metal tip 32, the second noble metal tip 32 side of the inner layer 27A is substantially flat-shaped.

Further, the depth E of the melted portion 42 from the flat surface (joining surface) F1 toward the inner layer 27A along the axial CL1 direction of the above-described melted portion 42 is set to 0.1 mm or more, and the shortest distance between the melted portion 42 and the inner layer 27A is set to 0.1 mm or more. Further, the shortest distance between the flat surface (joining surface) F1 and the inner layer 27A is set to 0.4 mm or less. Further, the outer diameter W of the second noble metal tip 32 and the lateral width C of the inner layer 27A satisfy $W \leqq C$.

Then, the production method of the spark plug 1 structured as described above will be described by attaching importance to the production method of the above-described ground electrode 27. First, the metallic shell 3 is prepared beforehand. Namely, a metallic material (for example, a ferrous material such as S15C or S25C, or stainless steel material) formed into a cylindrical shape is formed with a through hole by cold forging thereby formed into a rough shape. Thereafter, by performing cutting, the outer shape is fixed thereby obtaining a metallic shell intermediate article.

On the other hand, an intermediate article of the ground electrode 27 is produced. Namely, the intermediate article of the ground electrode 27 is in the form of a straight rod before being bent. The ground electrode 27 before being bent is, for example, obtained as follows.

Figure 6A:
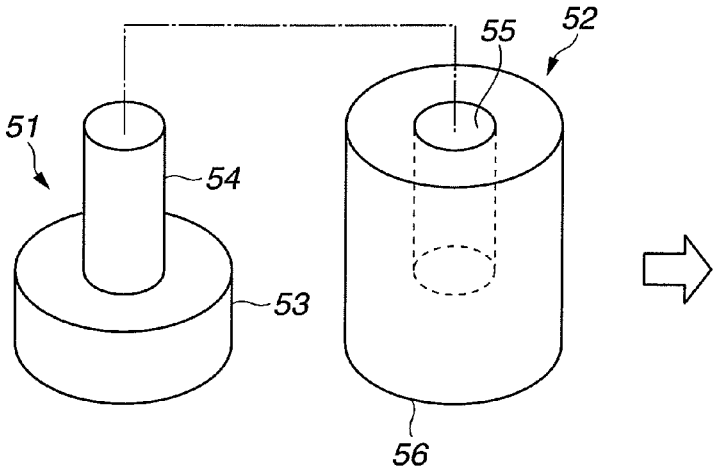
FIG. 6A is a perspective view showing a production process of the ground electrode.

Namely, as shown in FIG. 6A, a core material 51 made of a metallic material for forming the inner layer 27A and a bottomed tubular body 52 made of a metallic material for forming the outer layer 27B are prepared. The core material 51 includes a cylindrical pedestal portion 53 and a cylindrical core portion 54 protruding upward from the center of the upper surface of the pedestal portion 53 and integrally formed therewith. The cross sectional area of the core portion 54 is set larger than that of the inner layer 27A. On the other hand, the bottomed tubular body 52 has a recessed portion 55 of an equal size to the core portion 54 and a bottomed portion 56 as is so named. Further, the outer peripheral wall of the recessed portion 55 is set thicker than the outer layer 27B.

Figure 6B:
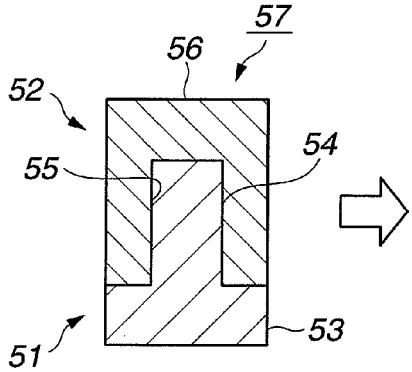
FIG. 6B is a schematic sectional view showing a production process of the ground electrode.

As shown in FIG. 6B, the core portion 54 of the core material 51 is inserted into the recessed portion 55 of the bottomed tubular body 52 thereby forming a cup material 57 having a core-sheath structure.

Figure 6C:
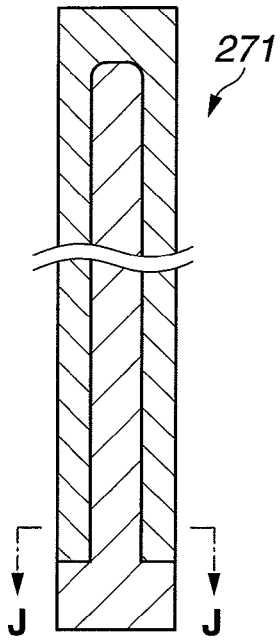
FIG. 6C is a schematic sectional view showing a production process of the ground electrode.

Then, the cup material 57 is subjected to a cold thinning process thereby forming a rod-shaped body 271 as shown in FIG. 6C. As the cold thinning process in this embodiment is cited, for example, a wire drawing process using a die, etc., an extrusion process using a female die, etc. and the like. In the meantime, the rod-shaped body 271 may be such one that is cut along a plane J-J of FIG. 6C and removed therefrom a portion corresponding to the above-described pedestal portion 53. By such cutting and removing, the inner layer 27A is not exposed when the ground electrode 27 is finally formed. Further, the external shape of the rod-shaped body 271 at this point in time may be optional and is formed into a cylindrical shape having a circular cross section in this embodiment.

Then, to the front end surface of the above-described metallic shell intermediate article is joined the rod-shaped body 271 by resistance welding. In the meantime, at the time of the resistance welding, there is caused a so-called "expulsion" and a work for removing the "expulsion" is carried out.

Figure 7A:
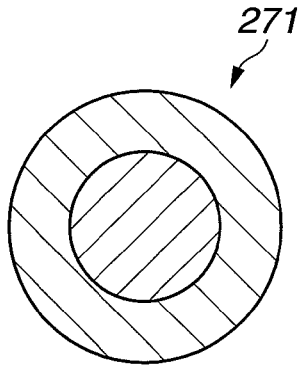
FIG. 7A is a schematic sectional view showing a production process of the ground electrode.
Figure 7B:
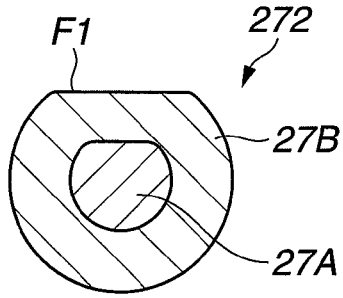
FIG. 7B is a schematic sectional view showing a production process of the ground electrode.

Thereafter, the rod-shaped body 271 is processed by swaging. In this connection, to the front end surface of the metallic shell intermediate article has already been welded the rod-shaped body 271. For this reason, at the time of swaging, under a condition where the metallic shell intermediate article is held, the rod-shaped body 271 welded to the metallic shell intermediate article can be introduced from the front end side thereof to a working portion (swaging die) of a swaging machine. Accordingly, it becomes unnecessary to take the trouble to make the ground electrode intermediate article longer for securing a holding portion at the time of swaging and cut off the above-described holding portion after swaging. As for a swager, it is desirable to use a plurality of swagers such as one only for making smaller in diameter and one for making smaller in diameter while forming a sectional shape having a flat surface F1 as in this embodiment, i.e., a so-called crushed shape. By the first step swaging, as shown in FIG. 7A, the rod-shaped article 271 is made further reduced in diameter and by the second step swaging, as shown in FIG. 7B, further reduced in diameter while being formed with the flat surface F1 and forming a ground electrode intermediate article 272 in which a part of the inner layer 27A (the side to which the second noble metal tip 32 is welded later) is deformed into a substantially flat shape. In the meantime, the ground electrode intermediate article 272 may be welded to the front end surface of the metallic shell intermediate article after the swaging process of the rod-shaped article 271.

After the above-described swaging process, a thread portion 15 may be formed by at a predetermined portion of the metallic shell intermediate article by rolling. By this, the metallic shell 3 to which the ground electrode intermediate article 272 that is reduced in diameter but before being bent is welded is obtained. To the metallic shell 3 to which the ground electrode intermediate article 272 is welded is applied zinc plating or nickel plating. In the meantime, in order to improve the corrosion resistance, the surface of the metallic shell may be processed by chromate treatment.

Figure 7C:
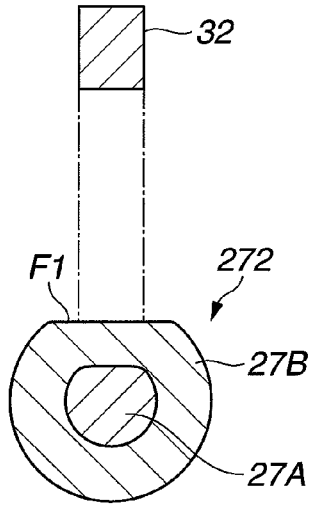
FIG. 7C is a schematic sectional view showing a production process of the ground electrode.

Further, as shown in FIG. 7C, to the front end portion of the ground electrode intermediate article 272 is temporarily welded by resistance welding as described above and, in addition to that, joined by laser welding or electron beam welding the above-described noble metal tip 32. In the meantime, to make the welding more assured, removal of plating of the welding portion is performed prior to the welding or masking is provided to the portion to be welded at the time of the plating process. Further, the welding of the tip may be performed after the assembly that will be described later.

On the other hand, the forming process of the insulator 2 is performed independently of the metallic shell 3. For example, a raw grain material for forming the insulator is prepared by using a powder material mainly consisting of alumina and containing binder, etc., and by using this raw grain material a tubular body is formed by rubber pressing. The tubular body obtained is processed by grinding and fixed in shape. The body fixed in shape is inserted into a sintering furnace and sintered, whereby the insulator 2 is obtained.

Further, independently of the metallic shell 3 and insulator 2 is prepared the center electrode 5. Namely, a Ni-system alloy is processed by forging, and at its central portion is provided a copper core for improving the heat radiation ability. To the front end portion of the center electrode is joined the first noble metal tip 31 by laser welding or the like.

Then, the center electrode 5 to which the first noble metal tip 31 is joined, which is obtained as described above, and the terminal electrode 6 are sealingly fixed to the axial hole 4 of the insulator 2 by a glass seal layer 8. As the glass seal layer 8 is generally used one that is obtained by mixing borosilicate glass and metal powder and adjusting the same. Then, the center electrode 5 is first put into a state of being held inserted into the axial hole 4, and after the terminal electrode is put into a state of being held pushed from the rear after the adjusted seal material is poured into the axial hole 4 of the insulator 2, sintering is performed within the sintering furnace. In the meantime, at this time, a glazing layer may, at the same time, be formed by sintering on a surface of a rear end side body portion of the insulator 2 or the glazing layer may be formed beforehand.

Thereafter, the insulator 2 equipped with the center electrode 5 and terminal electrode 6 that are respectively prepared as described above and the metallic shell 3 equipped with the ground electrode intermediate article 272 to which the second noble metal tip 32 is welded are assembled together. More specifically, by cold crimping or hot crimping the rear end portion of the metallic shell 3, which is formed relatively thin, the insulator 2 is partially and circumferentially surrounded within the metallic shell 3 and held within the same.

Finally, by bending the ground electrode intermediate article 272, adjustment of the spark discharge gap 33 between the center electrode 5 (the first noble metal tip 31 thereof) and the ground electrode 27 (the second noble metal tip 32 thereof) is executed.

By passing through such a series of processes, the spark plug 1 having the above-described structure is produced.

Figure 3:
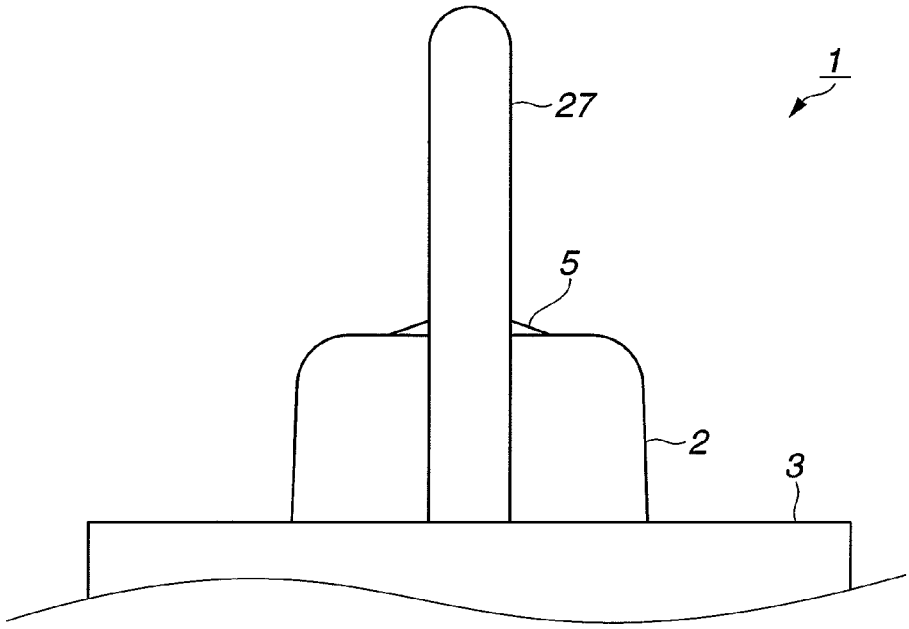
FIG. 3 is a side view showing a spark plug as viewed in the direction at right angles to FIG. 2.
Figure 4:
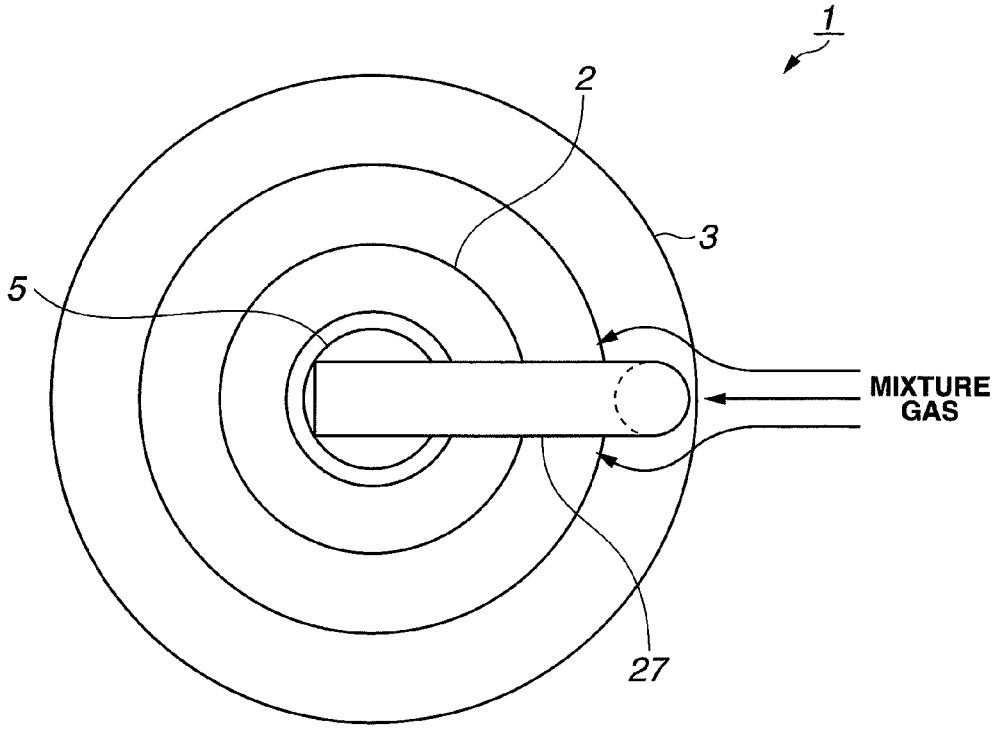
FIG. 4 is a plan view showing a state of the spark plug as viewed from a front end side.

As having been described in detail, according to the present invention, with respect to the spark plug 1 obtained, the ground electrode 27 has more at the front end side than at least the center of the spark discharge gap 33 and at the back surface on the side opposite to the center electrode 5 an outwardly curved surface (circular arc-shaped in cross section). For this reason, as shown, for example, in FIGS. 3 and 4, even if the mixed gas has such a positional relation as to directly strike the back surface of the ground electrode 27, it is easy for the mixed gas to turn around into the inside of the ground electrode 27 and reach the spark discharge gap 33. As a result, it becomes possible to prevent the ignitability from being lowered. Further, since the front end of the second noble metal tip 32 protrudes more toward the first noble metal tip 31 side than the imaginary circle 27C that is formed by extending the circular arc shape of the curved surface, the discharge voltage can be lowered.

Further, the ground electrode 27 has the outer layer 27B made of nickel alloy or the like and the inner layer 27A made of metal having a better thermal conductivity than the outer layer 27B. For this reason, the inner layer 27A works for active heat radiation such that the so-called "heat drawing" becomes better. Accordingly, at high-speed driving or the like, it becomes possible to inhibit a drawback due to a temperature rise of the ground electrode 27 and the second noble metal tip 32, i.e., lowering of the durability such as the oxidation resistance and wear resistance.

Further, in this embodiment, the second noble metal tip 32 of the ground electrode 27 is joined to the flat surface F1 substantially in the form of a plane. For this sake, as compared with the case where the joining surface is formed into a curved surface, complication of the joining work can be avoided with ease and improvement in the joining strength can be attained.

Moreover, the second noble metal tip 32 is joined to the flat surface (joining surface) F1 by way of the melted portion 42 that is formed by processing of laser welding or electron beam welding. For this sake, improvement of the joining strength of the second noble metal tip 32 is attained and more stabilization of the joining state is attained.

Furthermore, the melted portion 42 is in a non-contact state with the inner layer 27A. For this sake, it becomes possible to inhibit lowering of the oxidation resistance due to contact between the melted portion 42 and the inner layer 27*a*, which causes formation of oxidized layer. On the other hand, in order to improve the joining strength of the second noble metal tip 32, it is desired that the melted portion 42 is formed deep. In this connection, in a cross section of the ground electrode 27 as viewed from the front end surface side of the ground electrode 27 along the axis CL1, the second noble metal tip 32 side shape of the inner layer 27A is substantially flat. For this sake, even when the depth of the melted portion 42 is made relatively large, it is hard for the melted portion 42 and the inner layer 27A to contact. Accordingly, it becomes possible to improve the joining strength of the second noble metal tip 32 while inhibiting lowering of the oxidation resistance.

(Second Embodiment)

Then, the second embodiment will be described with reference to FIGS. 8 to 10. However, in the second embodiment, the same reference characters are used for the same or like parts as the first embodiment while their duplicate description being omitted, and the different point from the first embodiment will be mainly described.

In the first embodiment, in the cross section of the ground electrode 27 as viewed from the front end surface side of the ground electrode 27 along the axis CL1, the second noble metal tip 32 side shape of the inner layer 27A is substantially flat. In contrast to this, this embodiment features that, as shown in FIG. 8, the second noble metal tip 32 side shape of the inner layer 27 is recessed.

The ground electrode 27 is obtained, for example, in the following manner. Namely, as shown in FIG. 9A, a core member 51 made of a metallic material constituting the inner layer 27A and a bottomed tubular body 52 made of a metallic material constituting the outer layer 27B are first prepared. The core member 51 includes a cylindrical pedestal portion 53 and a core portion 54 integrally formed so as to protrude upward from the upper surface center of the pedestal portion 53 and having a cylinder partially and longitudinally cut off.

On the other hand, the bottomed tubular body 52 has a recessed portion 55 and a bottom portion 56 which are of the same size and shape as the above-described core portion 54.

Figure 9A:
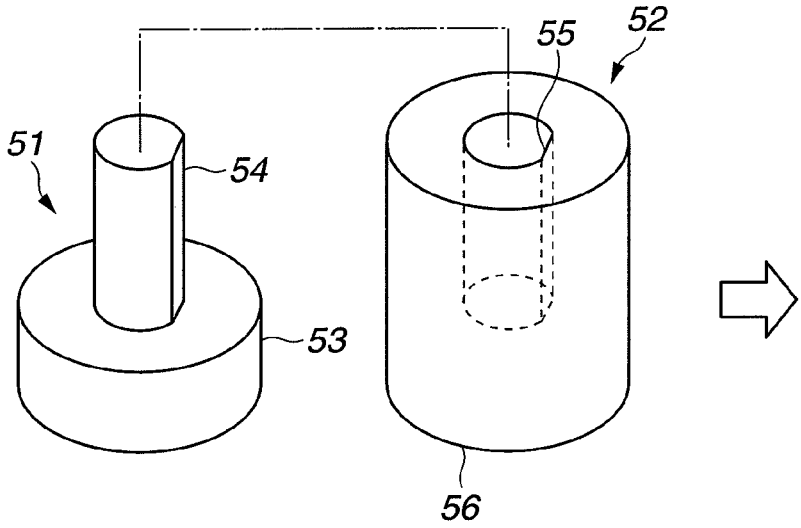
FIG. 9A is a schematic sectional view showing a production process of the ground electrode in the second embodiment.
Figure 9B:
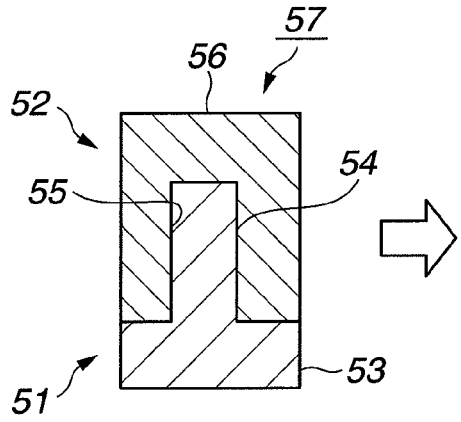
FIG. 9B is a schematic sectional view showing a production process of the ground electrode in the second embodiment.
Figure 9C:
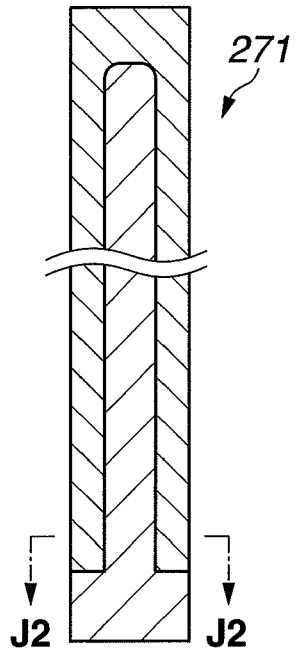
FIG. 9C is a schematic sectional view showing a production process of the ground electrode in the second embodiment.

Then, as shown in FIG. 9B, by fitting the core portion 54 of the core member 51 in the recessed portion 55 of the bottomed tubular body 52, a cup member 57 of a core-sheath structure is formed, and by treating the cup member 57 by a cold thinning process, a rod-shaped body 271 as shown in FIG. 9C is formed. Of course, similarly to the first embodiment, one from which a portion corresponding to the pedestal portion 53 is cut off by a plane passing the line J2-J2 of FIG. 9C may be employed as the rod-shaped body 271.

Figure 10A:
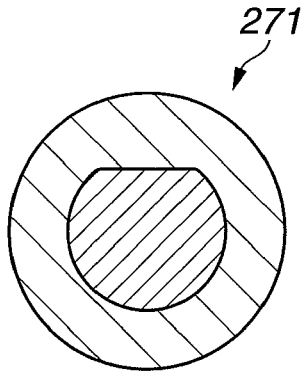
FIG. 10A is a schematic sectional view showing a production process of the ground electrode in the second embodiment.
Figure 10B:
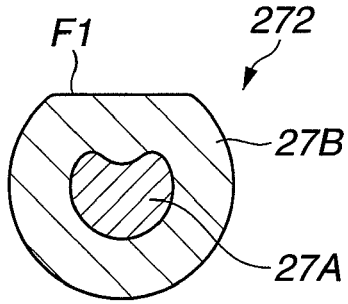
FIG. 10B is a schematic sectional view showing a production process of the ground electrode in the second embodiment.
Figure 10C:
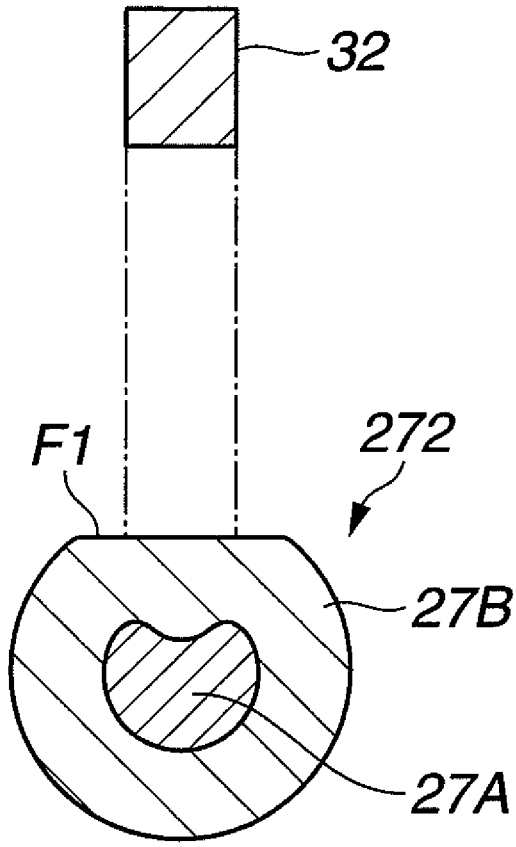
FIG. 10C is a schematic sectional view showing a production process of the ground electrode in the second embodiment.

Then, the rod-shaped body 271 is joined to the front end surface of the of the above-described metallic shell intermediate article by resistant welding, and similarly to the first embodiment, a swaging process of the rod-shaped body 271 is performed. Namely, by the first step swaging as shown in FIG. 10A, the rod-shaped body 271 is further reduced in diameter, and by the second step swaging is formed, as shown in FIG. 10B a ground electrode intermediate article 272 that is further reduced in diameter, formed with the flat surface F1 and a portion of the inner layer 27A (the side to which the second noble metal tip 32 is welded later) is deformed into a recessed shape. Other processes are the same as the above-described first embodiment.

Figure 8:
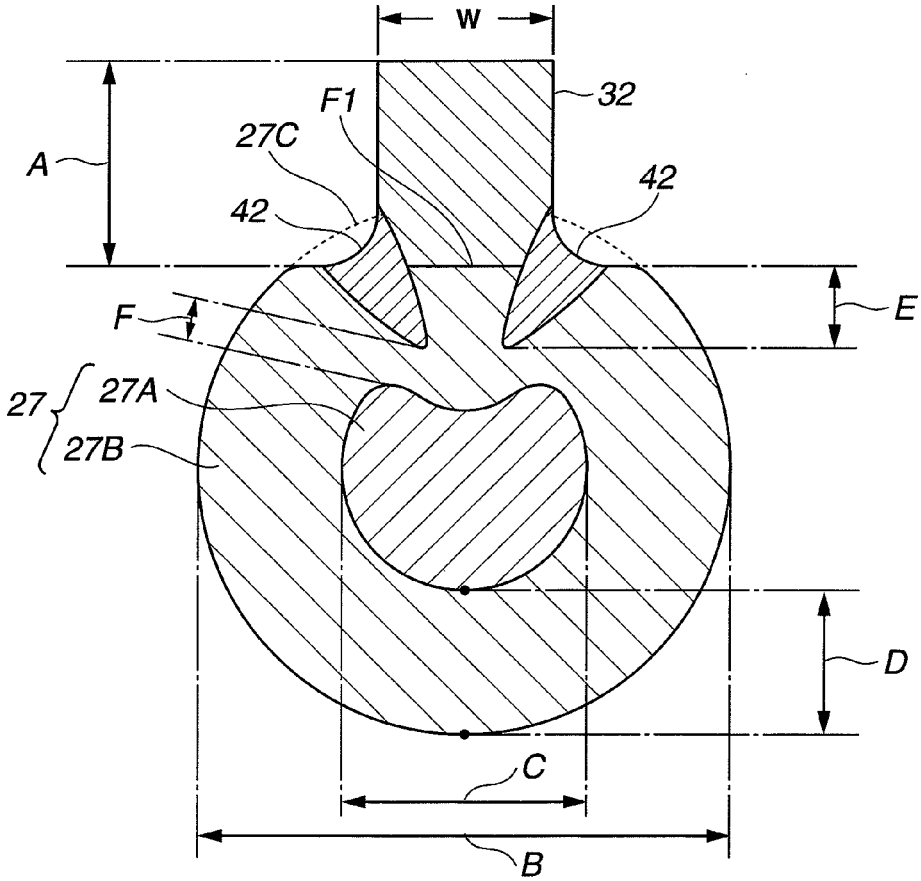
FIG. 8 is a schematic sectional view of a ground electrode, etc. in a second embodiment as viewed from a front end side of the ground electrode along an axis.

In this embodiment, as shown in FIG. 8, the protrusion height A of the second noble metal tip 32 from the joining surface, i.e., the flat surface F1 to the front end of the second noble metal tip 32 is set to 0.4 mm or more. Further, the depth E of the melted portion 42 from the flat surface (joining surface) F1 and toward the inner layer 27A along the axial CL1 direction is set to 0.1 mm or more, and the minimum distance F between the melted portion 42 and the inner layer 27A is set to 0.1 mm or more. Further, the minimum distance T between the flat surface (joining surface) F1 and the inner layer 27A is set to 0.4 mm or less. Further, the outer diameter W of the second noble metal tip 32 and the lateral width C of the inner layer 27A satisfy W≦C.

According to the second embodiment structure as described above, the second noble metal tip 32 side shape of the inner layer 27A is recessed. For this reason, as compared with the first embodiment, the melted portion 42 can be formed so as to be further deep. Accordingly, it can be attained to further improve the joining strength of the second noble metal tip 32 while inhibiting lowering of the oxidation resistance.

(Confirmation of Effect)

Herein, to confirm the above-described effect, various samples were prepared by varying the sectional area of the inner layer 27A, the sectional shape of the inner layer 27A, etc. and it was attempted to conduct various evaluations. The result of examination is described in the following.

Figure 11:
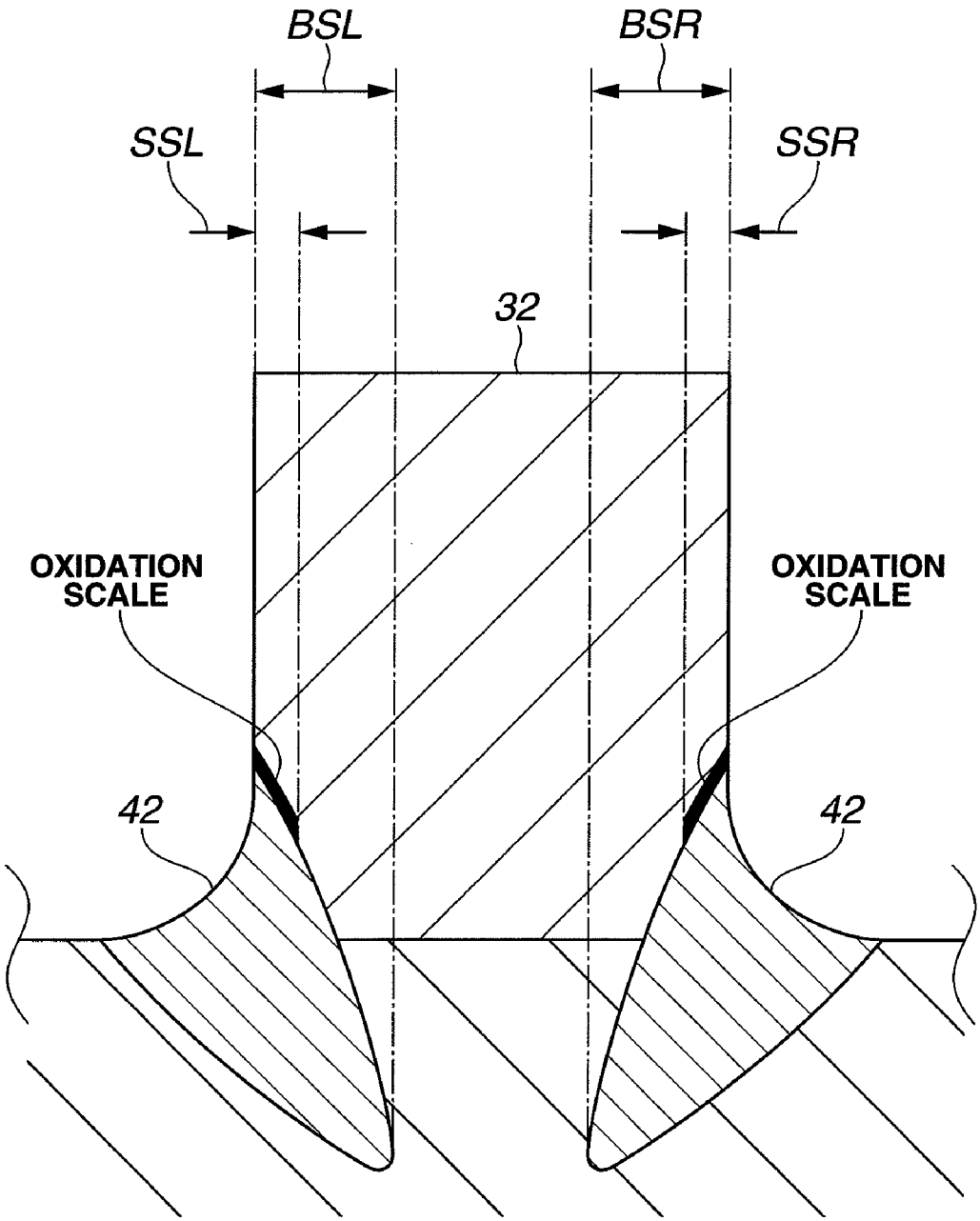
FIG. 11 is a schematic sectional view for explanation of the concept of the oxidation scale ratio.

First, samples were such spark plug samples (samples 1 to 9) with the screw diameter of M12, the protrusion height from the combustion chamber to the front end surface of the first noble metal tip 31 of 3.5 mm, and the spark discharge gap of 1.05 mm, and joined with an Ir-5Pt alloy with the diameter of 0.6 mm and the height of 0.8 mm as the first noble metal tip 31 and with a Pt-20Rh alloy with the diameter W of 0.7 mm and A of 0.8 mm as the second noble metal tip 32, the samples being varied in the sectional area of the inner layer 27A, the sectional shape, etc. variously, and with the samples being installed on a 3-cylinder in-line engine of 660 cc displacement, the engine was operated for 300 hours in total under the test condition of 4000 rpm, full throttle, ignition timing of 5° BTDC and A/F (air-to-fuel ratio) of 10.7 (however, samples were rotated every 50 hours (cylinders were also rotated)). Then, the consumption volume γ and the oxidation scale ratio δ of the spark plug samples after the test were measured. In the meantime, the consumption volume γ indicates the reduced amount of volume of the second noble metal tip 32 after the test from the initial volume. More specifically, the volume of the second noble metal tip 32 was measured using a CT scanner before the test, and the volume of the second noble metal tip 32 was similarly measured after the test. By subtracting the volume before the test from the volume after the test, the consumed volume was calculated. Further, the oxidation scale δ relates to the spark plug sample after the operation under the above-described test condition and is calculated by measuring, in a cross section of the ground electrode 27 as viewed from the front end surface side of the ground electrode 27 along the axis CL1, the depth (SSL+SSR) of the oxidation scale along the direction crossing at right angles the axis CL1, which oxidation scale is formed at the interface between the melted portion 42 and the second noble metal tip 32, relative to the depth (BSL+BSR) of the melted portion 42 along the direction crossing at right angles the axis CL1 as shown in FIG. 11.

The result of evaluation is shown in table 1 and table 2. However, in the tables, while "A", "E", "F" have already been explained, "B" indicates the lateral width of the ground electrode 27 in the direction crossing the axis CL1 at right angles, "C" indicates the lateral width of the inner layer 27A in the direction crossing the axis CL1 at right angles, and "D" indicates the distance between the point of the inner layer 27A, which is remotest from the center electrode 5, and the point of the outer layer 27B, which is remotest from the center electrode 5. Further, the samples 1 to 6 in the tables the second noble metal tip 32 side cross sectional shape of the inner layer 27A is flat or recessed, and in contrast the samples 7 to 9 are comparative examples and the inner layer 27A has a circular cross sectional shape. More specifically, as to the samples 1 to 6, the flat surface F1 is swaged so that the cross section of the second noble metal tip 32 side shape is flat or recessed, and as to the samples 7 to 9, the outer layer 27B which is initially cylindrical is formed with the flat surface F1 by removal (cutting), the cross section of the inner layer 27A being not shaped so as to be flat or recessed but circular. Further, the samples, except for the samples 1 and 7, satisfy the relation of W≦C.

TABLE 1

| Sample No. | Flat Surface Formation By Swaging | A (mm) | B (mm) | C (mm) | C/B | Sectional Area α of Inner Layer ($mm^2$) | Inner Layer Ratio β (%) | D (mm) | E (mm) | F (mm) | Consumed volume γ ($mm^3$) | Oxidation Scale Ratio δ (%) |
|---|---|---|---|---|---|---|---|---|---|---|---|---|
| 1 | Yes | 0.8 | 1.3 | 0.6 | 0.46 | 0.251 | 20.23 | 0.35 | 0.2 | 0.1 | 0.0498 | 26 |
| 2 | Yes | 0.8 | 1.3 | 0.72 | 0.55 | 0.361 | 29.09 | 0.29 | 0.2 | 0.06 | 0.0344 | 19 |
| 3 | Yes | 0.8 | 1.3 | 0.9 | 0.69 | 0.565 | 45.53 | 0.20 | 0.2 | 0 | 0.0246 | 95 |
| 4 | Yes | 0.8 | 1.3 | 0.9 | 0.69 | 0.565 | 45.53 | 0.20 | 0.15 | 0.05 | 0.0276 | 20 |
| 5 | Yes | 0.8 | 1.3 | 0.9 | 0.69 | 0.565 | 45.53 | 0.20 | 0.1 | 0.1 | 0.0286 | 45 |
| 6 | Yes | 0.8 | 1.3 | 0.9 | 0.69 | 0.565 | 45.53 | 0.20 | 0.05 | 0.15 | 0.0253 | 70 |

TABLE 1-continued

| Sample No. | Flat Surface Formation By Swaging | A (mm) | B (mm) | C (mm) | C/B | Sectional Area α of Inner Layer ($mm^2$) | Inner Layer Ratio β (%) | D (mm) | E (mm) | F (mm) | Consumed volume γ ($mm^3$) | Oxidation Scale Ratio δ (%) |
|---|---|---|---|---|---|---|---|---|---|---|---|---|
| 7 | Yes | 0.8 | 1.3 | 0.6 | 0.46 | 0.283 | 22.78 | 0.35 | 0.2 | 0 | 0.0438 | 92 |
| 8 | Yes | 0.8 | 1.3 | 0.72 | 0.55 | 0.407 | 32.81 | 0.29 | 0.2 | 0 | 0.0299 | 95 |
| 9 | Yes | 0.8 | 1.3 | 0.9 | 0.69 | 0.636 | 51.26 | 0.20 | 0.2 | 0 | 0.0234 | 96 |

TABLE 2

| Sample No. | Hardness (Hv) Center Electrode Side | Hardness (Hv) Back Surface Side |
|---|---|---|
| 1 | 223 | 195 |
| 2 | 235 | 202 |
| 3 | 245 | 210 |

As shown in the above-described Table 1, it is seen that there is a tendency that with increase of the sectional area α of the inner layer 27A, the heat drawing becomes better and the consumption volume γ decreases. However, it is revealed that if F is zero, that is, in case of the sample 3 in which the melted portion 42 is in contact with the inner layer 27A, the oxidation scale ratio δ is remarkably large, thus possibly causing a bad effect on the joining strength.

Further, in comparison between the sample 1 (embodiment) and the sample 7 (comparative example) and between and between the sample 2 (embodiment) and the sample 8 (comparative example) whose inner layer sectional areas α are close to each other, if it was tried to secure "2 mm" for the depth E of the melted portion 42 from the flat surface (joining surface) F1 toward the inner layer 27A along the axial CL1 direction, F became zero in case of the samples 7 and 8. Accordingly, it can be said that by forming the second noble metal tip 32 side cross sectional shape of the inner layer 27A into a flat shape or recessed shape, a larger depth E of the melted portion 42 in the axial CL1 direction can be secured.

On the other hand, regarding the sample 6 (E=0.05 mm) in which the depth E of the melted portion 42 from the flat surface (joining surface) F1 toward the inner layer 27A along the axial CL1 direction, was not sufficiently obtained, the oxidation scale ratio δ became relatively large, i.e., 70%. In other words, in case of obtaining a larger joining strength, it can be said desired that the depth E of the melted portion 42 from the flat surface (joining surface) F1 toward the inner layer 27A along the axial CL1 direction is "0.1 mm" or more.

In the meantime, as shown in Table 2, it was revealed that in the samples 1 to 3 of this embodiment (all of them being formed with the flat surface F1 of the ground electrode 27 by swaging), the center electrode 5 side portion of the outer layer 27B had a larger hardness than that of the back surface side portion on the side opposite to the center electrode 5. It is considered that this is because the center electrode 5 side portion is larger in the rate of work, for being formed with the flat surface F1 by swaging, thus causing the internal distortion and increasing the hardness.

In the meantime, the content of description of the above-described embodiment is not limitative but the following embodiments 3 to 5 can be employed.

(Third Embodiment)

Figure 12:
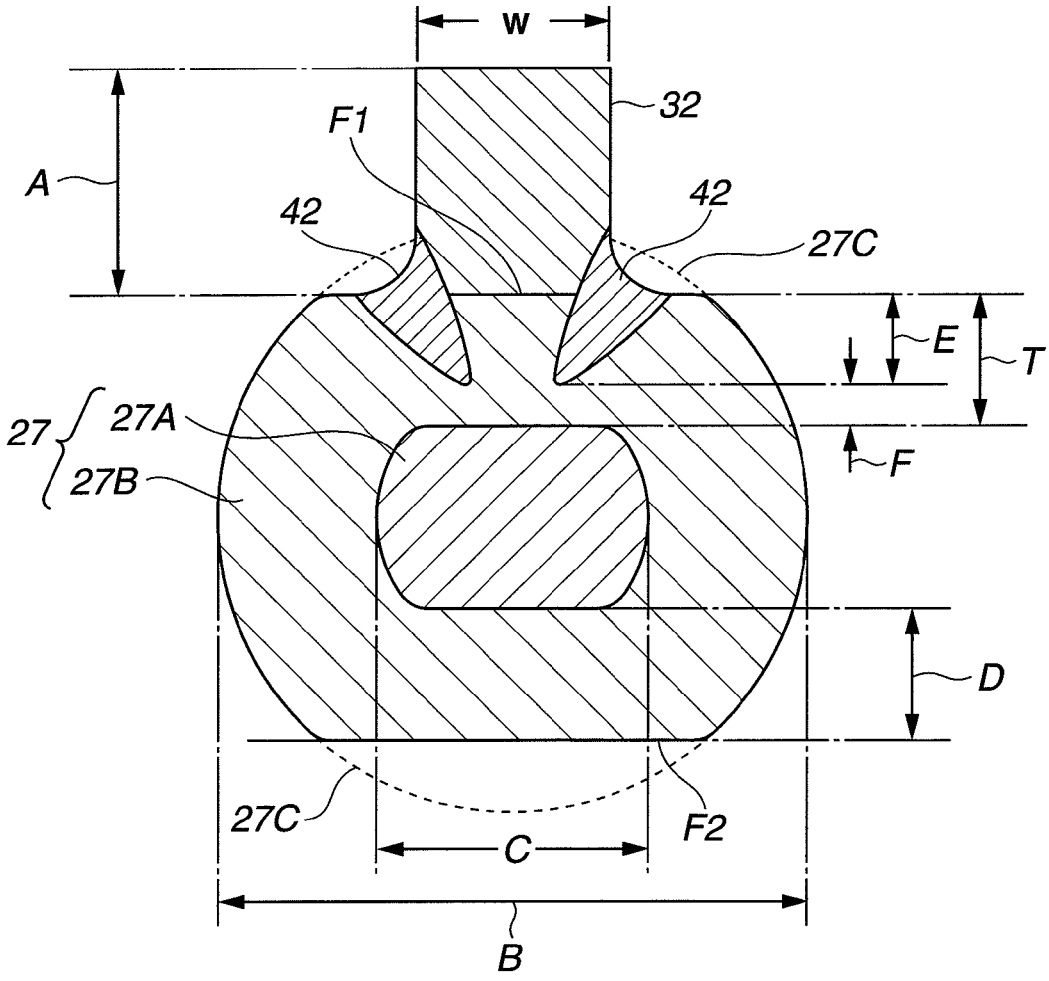
FIG. 12 is a schematic sectional view of a ground electrode, etc. in a third embodiment as viewed from a front end side of the ground electrode along an axis.

Then, the third embodiment will be described with reference to FIG. 12. However, in the third embodiment, the same reference characters are used for the same or like parts as the first embodiment while their duplicate description being omitted, and the different point from the first embodiment will be mainly described.

In the first embodiment, in the cross section of the ground electrode 27 as viewed from the front end surface side of the ground electrode 27 along the axis CL1, only the second noble metal tip 32 side is provided with the flat surface F1. In contrast to this, in this embodiment, the back surface on the side opposite to the flat surface F1 is also provided with a flat surface F2. Further, this embodiment features that the inner layer 27A has a pair of flat surfaces corresponding to not only the flat surface F1 but also the flat surface F2.

In the above-described cross section, the portions of the ground electrode 27 except for the flat surfaces F1 and F2 are formed into a pair of outwardly curved surfaces, and correspondingly to this, the inner layer 27A is also provided with a pair of outwardly curved surfaces. Such curved surfaces of the ground electrode 27 are provided for promoting turning around of the mixture gas into the spark discharge gap. In the meantime, since the front end of the second noble metal tip 32 protrudes more toward the first noble metal tip side than the circumference of an imaginary circle 27C that is formed by extending the pair of curved surfaces, the discharge voltage can be reduced.

The protrusion height A from the joining surface of the second noble metal tip 32, i.e., the flat surface F1 to the front end of the second noble metal tip 32 is set to 0.4 mm or more. Further, the depth E of the above-described melted portion 42 from the flat surface (joining surface) F1 toward the inner layer 27A along the axial CL1 direction is set to 0.1 mm or more, and the minimum distance F between the melted portion 42 and the inner layer 27A is set to 0.1 mm or more. Further, the minimum distance T between the flat surface (joining surface) F1 and the inner layer 27A is set to 0.4 mm or less. Further, the outer diameter W of the second noble metal tip 32 and the lateral width C of the inner layer 27A satisfies W≦C.

(Fourth Embodiment)

Then, the fourth embodiment will be described with reference to FIG. 13. However, in the fourth embodiment, the same reference characters are used for the same or like parts as the first embodiment while their duplicate description being omitted, and the different point from the first embodiment will be mainly described.

In the first embodiment, the second noble metal tip 32 is joined directly to the ground electrode 27 by laser welding. Accordingly, the melted portion 42 is formed so as to extend toward the inside of the ground electrode 27. In contrast to this, in this embodiment, as shown in FIG. 13, an intermediate member 43 is provided between the second noble metal tip 32 and the ground electrode 27. The intermediate member 43 is made of nickel alloy similarly to the outer layer 27B of the ground electrode 27. A base end portion of the intermediate member 43 is joined to the flat surface F1 by resistance welding. On the other hand, the base end portion of the intermediate member 43 is joined to the second noble metal tip 32 by laser welding. The melted portion 42 is formed at the interface between the second noble metal tip 32 and the intermediate member 43 and at a distance from the flat surface F1. Accordingly, even if the minimum distance T between the flat surface F1 and the melted portion 42 is made smaller, it is possible to prevent the melted portion 42 from reaching the inner layer 27A. Further, since as compared with the first embodiment, the volume of the second noble metal tip 32 can be made smaller, the amount of expensive noble metal used can be reduced.

The protrusion height A from the joining surface of the intermediate member 43, i.e. the flat surface F1 to the front end of the second noble metal tip 32 is set to 0.4 mm or more. Since the front end of the noble metal tip 32 protrudes more toward the first noble metal tip 31 side than the circumference of the imaginary circle 27C that is formed by extending the circular arc shape of the back surface of the ground electrode 27, the discharge voltage can be reduced. Further, the minimum distance T between the flat surface (joining surface) F1 and the inner layer 27A is set to 0.4 mm or less. Further, the outer diameter W of the second noble metal 32 and the lateral width C of the inner layer 27A satisfy W≦C.

(Fifth Embodiment)

Then, the fifth embodiment will be described with reference to FIG. 14. However, in the fifth embodiment, the same reference characters are used for the same or like parts as the fourth embodiment while their duplicate description being omitted, and the different point from the first embodiment will be mainly described.

In the fourth embodiment, the flat surface F1 is provided only on the intermediate member 43 side. In contrast to this, in this embodiment, as shown in FIG. 14, also the back surface on the side opposite to the flat surface F1 is provided with a flat surface F2. Further, this embodiment features that the inner layer 27A has a pair of flat surfaces corresponding to not only the flat surface F1 but also the flat surface F2.

In the above-described cross section, the portions of the ground electrode 27 except for the flat surfaces F1 and F2 are formed into a pair of outwardly curved surfaces, and correspondingly to this, the inner layer 27A is also provided with a pair of outwardly curved surfaces. Such curved surfaces of the ground electrode 27 are provided for promoting turning around of the mixture gas into the spark discharge gap. In the meantime, since the front end of the second noble metal tip 32 protrudes more toward the first noble metal tip 31 side than the circumference of an imaginary circle 27C that is formed by extending the pair of curved surfaces, the discharge voltage can be reduced.

The protrusion height A from the joining surface of the intermediate member 43, i.e., the flat surface F1 to the front end of the second noble metal tip 32 is set to 0.4 mm or more. Further, the minimum distance T between the flat surface (joining surface) F1 and the inner layer 27A is set to 0.4 mm or less. Further, the outer diameter W of the second noble metal tip 32 and the lateral width C of the inner layer 27A satisfy W≦C.

(Confirmation of Effect)

Further, in order to examine the effect of the relation between the outer diameter W of the second noble metal tip 32 and the lateral width C, various samples were prepared by holding the outer diameter W of the second noble metal tip 32, the total sectional area of the ground electrode 27 and the sectional area of the inner layer 27A constant and varying the lateral width B of the ground electrode 27 and the lateral width C of the inner layer 27A and it was attempted to conduct various evaluations. The result of examination is described in the following.

First, samples were such spark plug samples (samples 10 to 13) with the screw diameter of M12, the protrusion height from the combustion chamber to the front end surface of the first noble metal tip 31 of 3.5 mm, and the spark discharge gap of 1.05 mm, and joined with Ir-5Pt alloy with the diameter of 0.6 mm and the height of 0.8 mm as the first noble metal tip 31 and with Pt-20Rh alloy with the diameter W of 0.7 mm and A of 0.8 mm as the second noble metal tip 32, the samples being varied in the lateral width B of the ground electrode 27 and the lateral width B of the inner layer 27A variously, and with the samples being installed on a 3-cylinder in-line engine of 660 cc displacement, the engine was operated for 300 hours in total under the test condition of 4000 rpm, full throttle, ignition timing of 5° BTDC and A/F (air-to-fuel ratio) of 10.7 (however, samples were rotated every 50 hours (cylinders were also rotated)). In the meantime, the protrusion height H of the intermediate member 43 from the joining surface (flat surface Fl) is 0.35 mm, and the length of the second noble metal tip 32 is 0.45 mm. Then, the consumption volume γ and the oxidation scale ratio δ of the spark plug samples after the test were measured. In the meantime, the consumption volume γ indicates the reduced amount of volume of the second noble metal tip 32 after the test from the initial volume. More specifically, the volume of the second noble metal tip 32 was measured using a CT scanner before the test, and the volume of the second noble metal tip 32 was similarly measured after the test. By subtracting the volume before the test from the volume after the test, the consumed volume was calculated.

Figure 13:
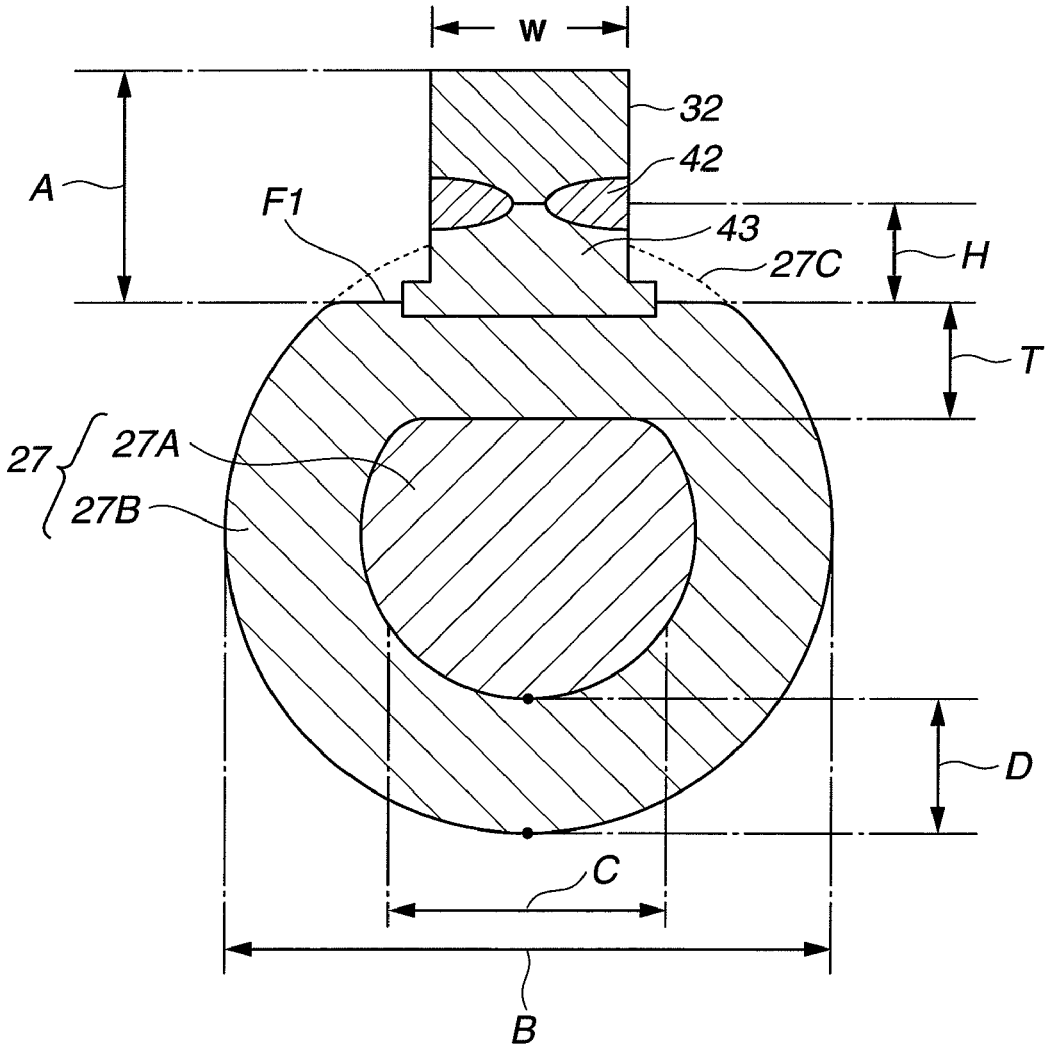
FIG. 13 is a schematic sectional view of a ground electrode, etc. in a fourth embodiment as viewed from a front end side of the ground electrode along an axis.
Figure 14:
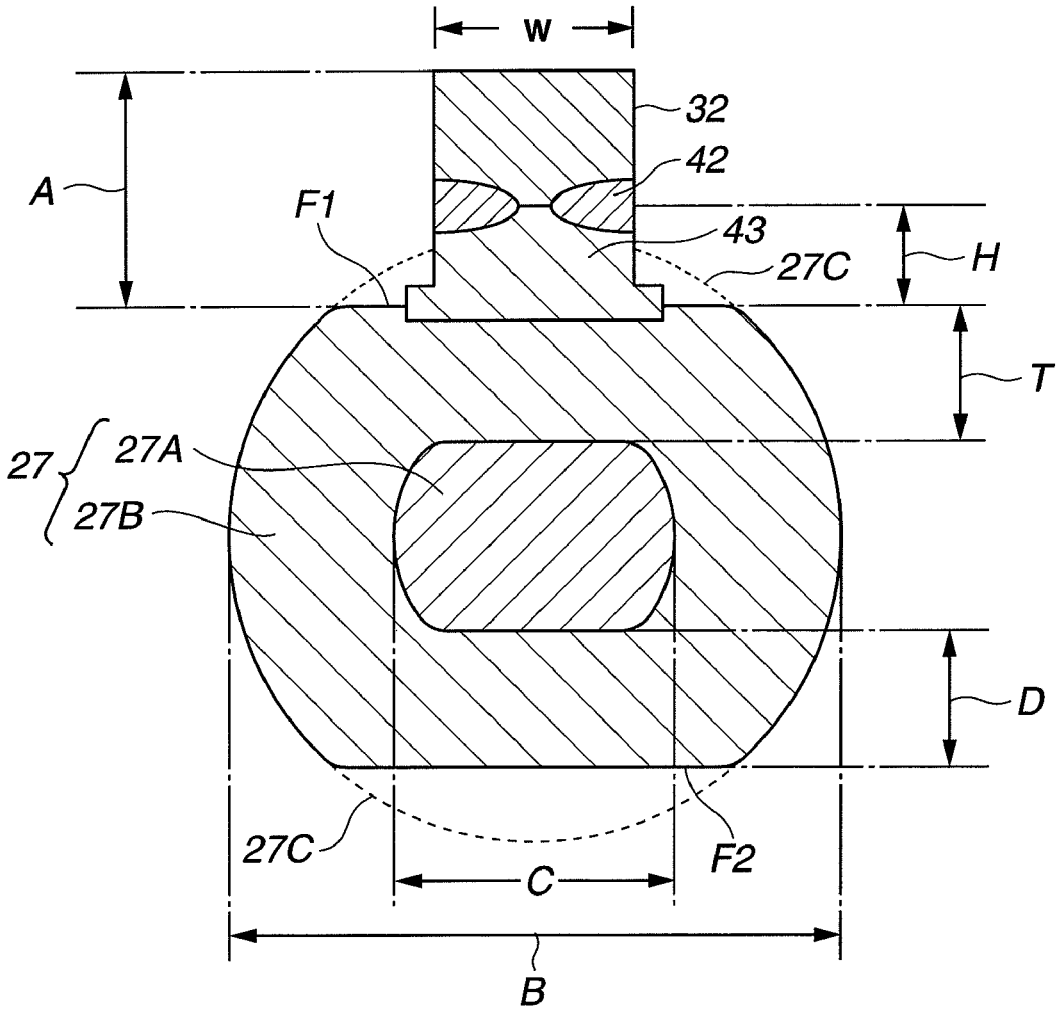
FIG. 14 is a schematic sectional view of a ground electrode etc. in a fifth embodiment as viewed from a front end side of the ground electrode along an axis.

Further, the sample 10 in Table has only the flat surface F1 as shown in FIG. 13, and on the contrary the samples 11 to 13 have the flat surface F1 and the flat surface F2 as shown in FIG. 14. Except for the sample 10, the samples satisfy the relation of W≦C.

TABLE 3

| Sample No. | Flat Surface Formed By Swaging | A (mm) | B (mm) | C (mm) | Total Sectional: Area of Ground Electrode ($mm^2$) | Total Sectional: Sectional Area of inner layer ($mm^2$) | T (mm) | consumption Volume γ ($mm^3$) |
|---|---|---|---|---|---|---|---|---|
| 10 | F1 | 0.8 | 1.3 | 0.6 | 1.124 | 0.251 | 0.3 | 0.0526 |
| 11 | F1, F2 | 0.8 | 1.4 | 0.7 | 1.242 | 0.251 | 0.3 | 0.0481 |
| 12 | F1, F2 | 0.8 | 1.45 | 0.8 | 1.243 | 0.252 | 0.305 | 0.0473 |
| 13 | F1, F2 | 0.8 | 1.5 | 0.9 | 1.245 | 0.259 | 0.308 | 0.047 |

As shown in the above-described Table 3, it will be seen that even if the total sectional area of the ground electrode 27 and the sectional area α of the inner layer 27A are substantially the same, the heat drawing becomes better with increase of the lateral width C of the inner layer 27A.

In the meantime, the content of the description of the above-described embodiments are not for the purpose of limitation but various modifications may be made thereto as described in the following.

Figure 15:
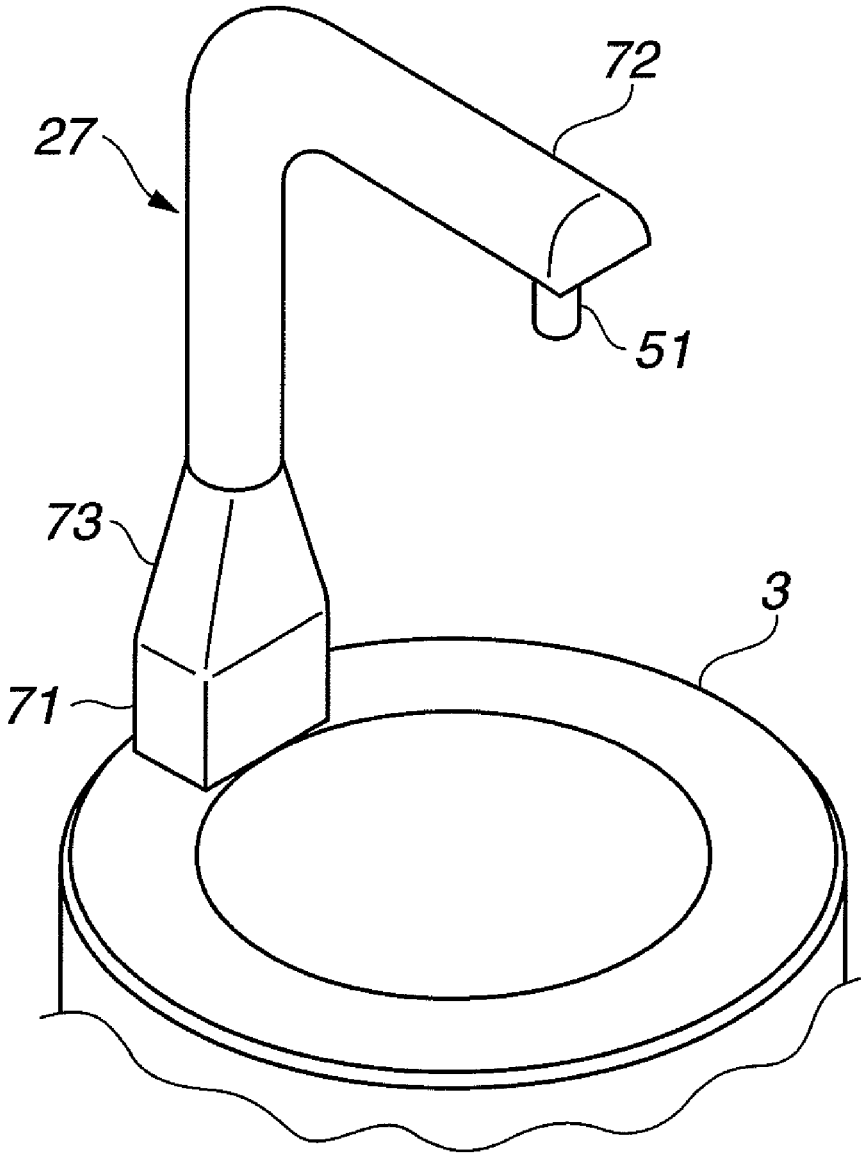
FIG. 15 is a perspective view schematically showing a ground electrode, etc. in a further embodiment.

(a) While in each of the above-described embodiments is utilized the ground electrode 27 having substantially the same cross sectional shape throughout the extent in the longitudinal direction, a ground electrode 27 having, as shown in FIG. 15, a base portion 71 joined to the front end surface of the metallic shell 3 and having a substantially rectangular cross sectional shape of a constant width, a small diameter portion 72 having a circular cross section (however, provided with a flat surface) and positioned more on the front end side than the base portion 71, and a tapered portion 73 gradually varying in the cross sectional shape along the longitudinal direction (however, in the figure, a center electrode, etc. are omitted) may be employed. In this case, increase in the joining area between the ground electrode 27 and the metallic shell 3, in its turn, increase in the joining strength can be attained.

In short, there is not any particular limitation on the shape of the ground electrode 27, provided that it has more on the front end side than the spark discharge gap 33 and at the back surface on the side opposite to the center electrode 5 side and/or at the side surface an outwardly curved surface.

(b) Further, while in each of the above-described embodiments the ground electrode 27 is shaped so as to have the flat surface F1 throughout the extend in the longitudinal direction, the portion more on the front end side than the bent portion of the ground electrode 27 may be swaged so as to be formed into a substantially flat surface shape. Further, at least only the portion to which the second noble metal tip 32 is joined may have the flat surface F1.

(c) It will suffice that the portion to which the second noble metal tip 32 is joined is substantially flat surface-shaped, and it is not needed to be of a flat surface in the strict sense of the word. Accordingly, it does not matter that the portion has some undulations.

(d) It will suffice to use, as a core member that constitutes the inner layer 27A, one that has a recessed shape from the beginning, though not referred to in each of the above-described embodiments. Further, it will suffice to dispose the inner layer 27A at an eccentric position with respect to the outer layer 27B.

(e) In the above-described embodiments, there is shown a cross section in which the melted portion 42 on one side is not connected with that on the other side, they may be connected with each other.

The invention claimed is:

1. A spark plug comprising:

a rod-shaped center electrode;

a first noble metal tip joined to a front end of said center electrode;

a substantially cylindrical insulator provided at an outer circumference of said center electrode;

a tubular metallic shell provided at an outer circumference of said insulator;

a ground electrode having a base end portion joined to a front end surface of said metallic shell, and a distal end portion located opposite to the base end portion and facing a front end portion of said center electrode, said ground electrode including an outer layer made of nickel alloy and an inner layer made of a material having a better thermal conductivity than the outer layer; and a second noble metal tip joined to the distal end portion of said ground electrode by way of a melted portion formed by one of laser welding and beam welding and forming a spark discharge gap between a tip end face of said second noble metal tip and a tip end face of the first noble metal tip, wherein, when a cross section of said ground electrode is taken along the axis of said second noble metal tip and viewed from the distal end side of said ground electrode:

the protrusion height A of said second noble metal tip from said joining surface to the tip end face of said second noble metal tip is 0.4mm or more, said ground electrode includes a substantially flat joining surface to which said second noble metal tip is joined and an outwardly curved surface, said inner layer has at said joining surface side one of a substantially flat surface and recessed surface, and the minimum distance F between the said melted portion and said inner layer is 0.1mm or more, wherein assuming that in said cross section, W denotes the width of the tip end face of said second noble metal tip and C denotes the width of said inner layer, in the direction parallel to said joining surface, it is satisfied $W \leqq C$.

2. A spark plug according to claim 1, wherein in said cross section, the depth E of said melted portion from said joining surface toward said inner layer along said axial direction is 0.1mm or more.

3. A spark plug comprising:

a rod-shaped center electrode;

a first noble metal tip joined to a front end of said center electrode;

a substantially cylindrical insulator provided at an outer circumference of said center electrode;

a tubular metallic shell provided at an outer circumference of said insulator;

a ground electrode having a base end portion joined to a front end surface of said metallic shell, and a distal end portion located opposite to the base end portion and facing a front end portion of said center electrode, said ground electrode including an outer layer made of nickel alloy and an inner layer made of a material having a better thermal conductivity than the outer layer;

an intermediate member joined to the distal end portion of said ground electrode; and a second noble metal tip joined to the front end portion of said ground electrode intermediate member by way of a melted portion formed by one of laser welding and beam welding and forming a spark discharge gap between a tip end face of the second noble metal tip and a tip end face of the first noble metal tip, wherein, when a cross section of said ground electrode is taken along the axis of said second noble metal tip and viewed from the distal end side of the ground electrode:

the protrusion height A of said second noble metal tip from said joining surface to the tip end face of said second noble metal tip is 0.4mm or more, said ground electrode includes a substantially flat joining surface to which said second noble metal tip is joined and an outwardly curved surface, said inner layer has at a side of said joining surface one of a substantially flat surface or and recessed surface, and said melted portion is disposed at a distant distance from said joining surface, wherein assuming that in said cross section, W denotes the width of the tip end face of said second noble metal tip and C denotes the width of said inner layer, in the direction parallel to said joining surface, it is satisfied $W \leqq C$.

4. A spark plug according to claim 3, wherein in said cross section, the shortest distance between said joining surface and said inner layer is smaller than the protrusion height H from said joining surface of said intermediate member.

5. A spark plug according to claim 1, wherein in said cross section, the shortest distance T between said joining surface and said inner layer is 0.4mm or less.

6. A spark plug according to claim 1, wherein in said cross section, a portion of said outer layer which is on a side of said joining surface has a larger hardness than a portion on a back surface side which is a side opposite to said joining surface.

7. A spark plug according to claim 1, wherein said curved surface has a circular arc shape, and the tip end face of said second noble metal tip protrudes more toward a side of said first noble metal tip than an imaginary circle that is formed by extending said circular arc shape of said curved surface.

* * * * *